US009458975B2

(12) United States Patent
Fedosik et al.

(10) Patent No.: US 9,458,975 B2
(45) Date of Patent: Oct. 4, 2016

(54) HEADLIGHT LENS FOR A VEHICLE HEADLIGHT

(75) Inventors: Dmitry Fedosik, Jena (DE); Wolfram Wintzer, Jena (DE)

(73) Assignee: Docter Optics SE, Neustadt an der Orla (DE)

( * ) Notice: Subject to any disclaimer, the term of this patent is extended or adjusted under 35 U.S.C. 154(b) by 607 days.

(21) Appl. No.: 13/990,077

(22) PCT Filed: Nov. 11, 2011

(86) PCT No.: PCT/EP2011/005699

§ 371 (c)(1),
(2), (4) Date: May 29, 2013

(87) PCT Pub. No.: WO2012/072189

PCT Pub. Date: Jun. 7, 2012

(65) Prior Publication Data

US 2013/0258694 A1 Oct. 3, 2013

(30) Foreign Application Priority Data

Dec. 3, 2010 (DE) ..... 10 2010 053 185
Feb. 1, 2011 (DE) ..... 10 2011 009 950
Jul. 11, 2011 (DE) ..... 10 2011 107 058

(51) Int. Cl.
*F21S 8/10* (2006.01)

(52) U.S. Cl.
CPC ..... *F21S 48/1225* (2013.01); *F21S 48/1159* (2013.01); *F21S 48/1163* (2013.01); *F21S 48/12* (2013.01); *F21S 48/1241* (2013.01); *F21S 48/1266* (2013.01); *F21S 48/1275* (2013.01); *F21S 8/10* (2013.01)

(58) Field of Classification Search
CPC ..... B60Q 1/0035; B60Q 1/04; B60Q 1/16; F21S 48/1154; F21S 48/1225; F21S 48/1241; F21S 48/1258; F21S 48/1259; F21S 48/1275; F21S 48/12668; F21S 48/12; F21S 48/1266; F21S 8/10; F21S 8/12; F21S 48/115; F21V 5/04; F21V 13/02; F21V 13/04; F21W 2101/10; F21Y 101/02
See application file for complete search history.

(56) References Cited

U.S. PATENT DOCUMENTS 4,142,877 A * 3/1979 Auracher ..... G02B 6/2804 156/219
5,257,168 A 10/1993 Davenport et al.
5,697,690 A 12/1997 Okuchi et al.
6,709,141 B1 3/2004 Sisti (Continued)

FOREIGN PATENT DOCUMENTS

DE 1165514 B 9/1964
DE 4121673 A1 1/1993

(Continued)

OTHER PUBLICATIONS

International Preliminary Report on Patentability (Chapter I) issued on Jun. 4, 2013 in connection with PCT/EP2011/005698.

(Continued)

*Primary Examiner* — Hargobind S Sawhney
(74) *Attorney, Agent, or Firm* — Barnes & Thornburg LLP

(57) ABSTRACT

Headlight lens for a vehicle headlight having a monolithic body of transparent material, the monolithic body including at least one light entry face, a light passage section and at least one optically operative light exit face.

24 Claims, 9 Drawing Sheets

(56) References Cited

U.S. PATENT DOCUMENTS

| | | | | |
|---|---|---|---|---|
| 7,073,931 | B2 | 7/2006 | Ishida | |
| 8,342,726 | B2 | 1/2013 | Fischer et al. | |
| 8,388,202 | B2 * | 3/2013 | Ohno | F21S 48/1159 362/308 |
| 2004/0156209 | A1 | 8/2004 | Ishida | |
| 2006/0087860 | A1 | 4/2006 | Ishida | |
| 2007/0147055 | A1 | 6/2007 | Komatsu | |
| 2007/0201241 | A1 | 8/2007 | Komatsu | |
| 2010/0033849 | A1 | 2/2010 | Seki et al. | |
| 2011/0148280 | A1 | 6/2011 | Kishimoto et al. | |

FOREIGN PATENT DOCUMENTS

| | | | | |
|---|---|---|---|---|
| DE | 4209957 | A1 | 9/1993 | |
| DE | 4320554 | A1 | 12/1993 | |
| DE | 19526512 | A1 | 1/1996 | |
| DE | 19742159 | A1 | 4/1998 | |
| DE | 10302969 | A1 * | 8/2004 | F21S 48/1241 |
| DE | 102005011760 | A1 | 9/2006 | |
| DE | 102008026626 | A1 | 12/2009 | |
| DE | 10252228 | B4 | 1/2010 | |
| DE | 102008049168 | A1 | 4/2010 | |
| DE | 102009008631 | A1 | 8/2010 | |
| EP | 1113216 | A2 | 7/2001 | |
| EP | 1357334 | A1 | 10/2003 | |
| EP | 1666787 | A1 | 6/2006 | |
| EP | 1767398 | A1 | 3/2007 | |
| EP | 2113222 | A1 | 11/2009 | |
| EP | 2159479 | A2 | 3/2010 | |
| EP | 2221219 | A1 | 8/2010 | |
| FR | 2860280 | A1 | 9/2004 | |
| GB | 2365962 | A | 2/2002 | |
| GB | 2399622 | B | 8/2005 | |
| GB | 2412159 | A | 9/2005 | |
| JP | 2005317226 | | 11/2005 | |
| WO | 2009/147070 | A1 | 12/2009 | |

OTHER PUBLICATIONS

International Preliminary Report on Patentability (Chapter I) issued on Jun. 4, 2013 in connection with PCT/EP2011/005699.
International Preliminary Report on Patentability (Chapter I) issued on Jun. 4, 2013 in connection with PCT/EP2011/005700.
International Preliminary Report on Patentability (Chapter I) issued on Jun. 4, 2013 in connection with PCT/EP2011/005701.
International Preliminary Report on Patentability (Chapter I) issued on Jun. 4, 2013 in connection with PCT/EP2011/005702.
International Preliminary Report on Patentability (Chapter I) issued on Jun. 4, 2013 in connection with PCT/EP2011/005703.
PCT International Search Report completed by the ISA/EP on Feb. 1, 2012 and issued in connection with PCT/EP2011/005698.
PCT International Search Report completed by the ISA/EP on Mer. 19, 2012 and issued in connection with PCT/EP2011/005699.
PCT International Search Report completed by the ISA/EP on Feb. 15, 2012 and issued in connection with PCT/EP2011/005700.
PCT International Search Report completed by the ISA/EP on Feb. 1, 2012 and issued in connection with PCT/EP2011/005701.
PCT International Search Report completed by the ISA/EP on May 9, 2012 and issued in connection with PCT/EP2011/005702.
PCT International Search Report completed by the ISA/EP on May 4, 2012 and issued in connection with PCT/EP2011/005703.

* cited by examiner (A-A)

HEADLIGHT LENS FOR A VEHICLE HEADLIGHT

CROSS REFERENCE TO RELATED APPLICATIONS

This application is the U.S. national phase of PCT/EP2011/005699 filed Nov. 11, 2011. PCT/EP2011/005699 claims the benefit under the Convention of German Patent Application Nos. 10 2010 053 185.5, 10 2011 009 950.6, and 10 2011 107 058.7 filed Dec. 3, 2010, Feb. 1, 2011, and Jul. 11, 2011 (respectively).

FIELD OF THE INVENTION

The invention relates to a headlight lens for a vehicle headlight, in particular for a motor vehicle headlight, wherein the headlight lens includes a monolithic body of transparent material including at least one optically operative (also termed 'effective') light entry face and at least one optically operative (effective) light exit face.

BACKGROUND INFORMATION

DE 203 20 546 U1 discloses a lens blank-moulded on both sides and having a curved surface, a planar surface and a retention edge integrally moulded onto the lens' edge, wherein a supporting edge of a thickness of at least 0.2 mm and projecting with respect to the planar surface is integrally formed onto the retention edge. Herein, the supporting edge is integrally formed onto the outer circumference of the headlight lens. A further headlight lens having a supporting edge is disclosed e.g. by DE 10 2004 048 500 A1.

DE 20 2004 005 936 U1 discloses a lens for illuminating purposes, in particular a lens for a headlight for mapping or imaging light emitted from a light source and reflected by a reflector for generating a predetermined illumination pattern, said lens having two surfaces opposing each other, wherein areas of different optical dispersion effects are provided on at least a first surface.

DE 103 15 131 A1 discloses a headlight for vehicles having at least one extensive luminous field including a plurality of illuminating element (diode)-chips and an optical element arranged in the light path of the light beam emitted by the luminous field, wherein the illuminating element chips of the luminous field are arranged in a common recess, and that the recess, on a side facing the direction of light emission, has an outer edge which, in relation to the elimination element chips, is spatially arranged such that a predetermined gradient of light density is formed in a light dispersion of the headlight in the area of the outer edges.

DE 10 2004 043 706 A1 discloses an optical system for a motor vehicle headlight for dispersing a beam of light rays from an illuminant, with an optical primary element having an optical face including a break or discontinuity extending along a line, being provided, wherein the optical face is formed to be smooth at least on one side adjacent the discontinuity so that the beam of light rays is separated into two partial beams of light rays. Herein, it is provided that at least one of the partial beams of light rays has a sharp edge of limitation. Moreover, the optical system comprises an optical secondary element for imaging the sharp edge of limitation on to a predetermined light-dark-boundary.

EP 1 357 333 A2 discloses a light source device for a vehicle light which has an element emitting semiconductor light, which element is arranged on an optical axis of the light source device and emits its light essentially in an orthogonal direction with regard to the optical axis.

Further illumination facilities in context with vehicles are disclosed by DE 42 09 957 A1, DE 41 21 673 A1, DE 43 20 554 A1, DE 195 26 512 A1, DE 10 2009 008 631 A1, U.S. Pat. Nos. 5,257,168 and 5,697,690.

It is, in particular, an object of the invention to suggest an improved headlight lens for a vehicle headlight, in particular for a motor vehicle headlight. It is a further object of the invention to reduce the costs for manufacturing vehicle headlights.

SUMMARY

The aforementioned object is achieved by a headlight lens for a vehicle headlight, in particular for a motor vehicle headlight, wherein the headlight lens includes a particularly blank-moulded monolithic body of transparent material including at least one optically operative light entry face and at least one optically operative light exit face, and wherein the monolithic body comprises a light tunnel which, via a bend or a (blank-moulded) curve or curvature and passes (or transits) into a light passage section (Remark by translator: section through which incident light is guided or conducted to pass therethrough, might also be termed 'light conductive section').

An optically operative or effective light entry (sur)face or an optically operative or effective light exit (sur)face are (constituted by) an optically operative or effective surface of the monolithic body. In the sense of the invention, an optically operative surface is, in particular, a surface of the transparent body, at which surface light will be refracted, when using the headlight lens according to its purpose. In the sense of the invention an optically operative surface is. in particular, a surface at which the direction of light which passes through this surface will be changed when using the headlight lens according to its purpose.

In the sense of the invention, transparent material is particularly glass. In the sense of the invention, transparent material is particularly inorganic glass. In the sense of the invention, transparent material is particularly silicate glass. In the sense of the invention, transparent material is particularly glass as described in document PCT/EP2008/010136. In the sense of the invention, glass particularly comprises 0.2 to 2% by weight $Al_2O_3$,
0.1 to 1% by weight $Li_2O$,
0.3 (in particular 0.4) to 1.5% by weight $Sb_2O_3$,
60 to 75% by weight $SiO_2$,
3 to 12% by weight $Na_2O$,
3 to 12% by weight $K_2O$, and
3 to 12% by weight CaO.

In the sense of the invention, the term blank-moulding is, in particular, to be understood in a manner that an optically operative surface is to be moulded under pressure such that any subsequent finishing or post-treatment of the contour of this optically operative surface may be dispensed with or does not apply or will not have to be provided for, respectively. Consequently, it is particularly provided for that, after blank moulding, a blank-moulded surface is not ground, i.e. it need not be treated by grinding.

In the sense of the invention a light tunnel is in particular characterised in that essentially total reflection takes place at its lateral surfaces, so that light entering the light entry face is guided through the tunnel as a light guide. In this sense of the invention a light tunnel is in particular a light guide or light conductor. In particular, it is provided for that total reflection is achieved and the longitudinal surfaces of the light tunnel. In particular, it is provided for that the longitudinal surfaces of the light tunnel are adapted for total reflection. In particular, it is provided for that total reflection is achieved at the surfaces of the light tunnel essentially oriented in the direction of the optical axis of the light tunnel. In particular, it is provided for that the surfaces of the light tunnel essentially oriented in the direction of the optical axis of the light tunnel are adapted for total reflection. A light tunnel, in the sense of the invention, in particular tapers in the direction of its light entry face. A light tunnel, in the sense of the invention, in particular tapers in the direction towards its light entry face by at least 3°. A light tunnel, in the sense of the invention, in particular tapers in the direction towards its light entry face by at least 3° with respect to its optical axis. A light tunnel, in the sense of the invention, in particular tapers at least partially in the direction towards its light entry face. A light tunnel, in the sense of the invention, in particular tapers at least partially in the direction towards its light entry face by at least 3°. A light tunnel, in the sense of the invention, in particular tapers at least partially in the direction towards its light entry face by at least 3° with respect to its optical axis.

It is, in particular, provided for that the surface of the headlight lens not show a break or discontinuity in the bend, but rather a curve or curvature. In an embodiment of the radius of curvature is no more than 5 mm. In an expedient embodiment the radius of curvature is no more than 0.25 mm, in particular no more than 0.15 mm, in particular no more than 0.1 mm. In another embodiment of the invention the radius of curvature of the curve in the bend is at least 0.05 mm. In another embodiment of the invention the radius of curvature of the curve in the bend is approximately 50 nm. It is, in particular, provided that the surface of the headlight lens is blank-moulded in the area of the bend.

In another embodiment of the invention the light tunnel is arranged between the bend and the light entry face. In another embodiment of the invention the light passage section is arranged between the bend and the light exit face. In particular, it is provided that light, which enters the transparent body through the light entry face and enters the passage section in the area of the bend of the light tunnel will exit from the light exit face at an angle of between −20° and 20° with regard to the optical axis. In particular, it is provided for that light which enters the transparent body through the light entry face will exit from the light exit face at an angle of between −20° and 20° with regard to the optical axis. In particular, it is provided for that light which enters the transparent body through the light entry face and enters the passage section in the area of the bend of the light tunnel will exit from the light exit face essentially in parallel to the optical axis. It is, in particular, provided for that light, which enters the transparent body from the light entry face will exit from the light exit face essentially in parallel to the optical axis.

In another embodiment of the invention the bend includes an opening angle of at least 90°. In a further expedient embodiment of the invention the bend includes an opening angle of no more than 150°. In another embodiment of the invention the bend is arranged on the surface of the light passage section, which surface is facing the light entry face. In a further expedient embodiment of the invention the light passage section is configured for imaging the bend as a light-dark-boundary.

In another embodiment of the invention the monolithic body comprises at least one second light tunnel, which in particular passes into or merges with the light passage section with a bend (or via a curve/curvature). In a further expedient embodiment of the invention the first light tunnel and the second light tunnel touch at least at their transition into the light passage section.

In another embodiment of the invention the monolithic body comprises at least one third light tunnel, which in particular merges with the light passage section with a bend (or with a curve/curvature). In a yet further expedient embodiment of the invention the first light tunnel and the third light tunnel touch at least at their transition into the light passage section. In another embodiment of the invention the third light tunnel and the second light tunnel touch at least at their transition into the light passage section.

In another embodiment of the invention the headlight lens or the transparent body has a further light exit face as well as a further light entry face. In a further expedient embodiment of the invention at least 20% of the light entering the light entry face and exiting through the light exit face will exit through the light exit face after having exited from the monolithic body through the further light exit face and having entered into the monolithic body through the further light entry face. In another embodiment of the invention at least 10%, in particular at least 20% of the light entering the light entry face and exiting through the light exit face will exit through the light exit face without having exited from the monolithic body through the further light exit face and without having entered the monolithic body through the further light entry face. In a yet further expedient embodiment of the invention at least 90% of the light entering the light entry face and exiting through the light exit face will exit through the light exit face after having exited from the monolithic body through the further light exit face and having entered the monolithic body through the further light entry face. In another embodiment of the invention it is provided for that light which enters the transparent body through the light entry face and enters the passage section from the light tunnel in the region of the bend will either exit from the monolithic body through the further light exit face and enter the further light entry face of the monolithic body as well as it will exit from the monolithic body from the light exit face, or it will exit directly from the light exit face (without exiting from the further light exit face from the monolithic body and without entering the further light entry face of the monolithic body).

The aforementioned object is moreover achieved by a headlight lens—comprising in particular one or several of the aforementioned features—for a vehicle headlight, in particular for a motor vehicle headlight, wherein the headlight lens includes a particularly blank-moulded monolithic body of transparent material including an optically operative first light entry face, an optically operative first light exit face, at least one optically operative second light entry face, and at least one optically operative second light exit face.

In an embodiment of the invention at least 20% of the light entering the first light entry face and exiting through the second light exit face will exit through the second light exit face after having exited from the monolithic body through the first light exit face and having entered the monolithic body through the second light entry face.

In another embodiment of the invention at least 10%, in particular at least 20% of the light which enters the first light entry face and exits from the second light exit face will exit through the second light exit face without having exited from the monolithic body through the first light exit face and without having entered the monolithic body through the second light entry face.

In another embodiment of the invention at least 90% of the light entering the first light entry face and exiting from the second light exit face will exit through the second light exit face after having exited from the monolithic body through the first light exit face and entered into the monolithic body through the second light entry face.

In a still further embodiment of the invention the monolithic body comprises an area or a light passage section, respectively, for imaging an edge of the first light exit face as a light-dark-boundary.

In a yet further embodiment of the invention the monolithic body is designed as a light tunnel between the first light entry face and the first light exit face.

The aforementioned object is, moreover, achieved by a headlight lens for a vehicle headlight, in particular for a motor vehicle headlight—which lens comprises at least one or several of the aforementioned features—, wherein the headlight lens includes an in particular blank-moulded monolithic body of transparent material having at least one optically operative light entry face and at least one optically effective light exit face, and wherein the monolithic body comprises a light tunnel which passes over into or merges with a light passage section via a curve having a radius of curvature of between 0.25 mm and 0.05 mm.

The aforementioned object is, moreover, achieved by a vehicle headlight, in particular a motor vehicle headlight, wherein the vehicle headlight has a headlight lens—including in particular one or several of the aforementioned features—as well as a light source for introducing light into or making it enter the first light entry face. In an embodiment of the invention the light source comprises at least one LED or an array of LED's. In an expedient embodiment of the invention the light source comprises at least one OLED or an array of OLED's. For example the light source may as well be a plane luminous field. The light source may also comprise light element chips as have been disclosed by DE 103 15 131 A1. A light source may also be a laser. A laser to be used has been disclosed in ISAL 2011 Proceedings, page 271ff.

In a further expedient embodiment of the invention the vehicle headlight has no secondary optic associated with the headlight lens. A secondary optic, in the sense of the invention, is in particular an optical device for aligning light which exits from the light exit face or from the second light exit face, respectively. A secondary optic, in the sense of the invention, is in particular an optical element for aligning light separated from and/or subordinated with regard to the headlight lens. A secondary optic, in the sense of the invention is, in particular, no cover disc or protection plate, but an optical element provided for aligning light. As an example for a secondary optic there is disclosed e.g. a secondary lens in DE 10 2004 043 706 A1.

In another embodiment of the invention the light source and the (first) light entry face are configured and associated with each other such that light from the light source enters the light entry face at a luminous flux density of at least 75 $lm/mm^2$.

In particular, it is provided for that the bend or the edge, respectively, which is mapped as light (bright)-dark-boundary lies, in the lower region of the light tunnel.

The aforementioned headlight lenses may be manufactured by means of process in which the monolithic body is blank-moulded between a first partial mould and at least one second partial mould such that a first region of the first light entry face is formed by means of the first partial mould and a second region of the first light entry face is moulded by means of the second partial mould;

that a first region of the first light exit face is formed by means of the first partial mould and a second region of the first light exit face is formed by means of the second partial mould;

that a first region of the second light entry face is formed by means of the first partial mould and a second region of the second light entry face is formed by means of the second partial mould and/or that a first region of the second light exit face is formed by means of the first partial mould and a second region of the second light exit face is formed by means of the second partial mould.

In pressing it is, in particular, provided for that the first partial mould and the second partial mould are moved to approach each other. Herein, the first partial mould may be made to approach the second partial mould and/or the second partial mould can be made to approach the first partial mould.

Alternatively, the aforementioned headlight lenses may be manufactured by means of a common (pressure) injection moulding procedure. Furthermore, the aforementioned optical components or headlight lenses, respectively, may alternatively be manufactured by means of a procedure disclosed in DE 11 2008 003 157, wherein it is, in particular, provided for that a blank of glass is heated such that it assumes a viscosity of between $10^4$ Pa*s and $10^5$ Pa*s, in particular of between $10^4$ Pa*s and $5 \cdot 10^5$ Pa*s, and wherein the blank is press-moulded after heating in an injection (pressure) mould to (press-) form a headlight lens.

In the sense of the invention, a motor vehicle is, in particular, a land vehicle individually to be used in road traffic. In the sense of the invention, motor vehicles are, in particular, not restricted to land vehicles including a combustion engine.

Further advantages and details may be taken from the following description of the examples of embodiments.

DETAILED DESCRIPTION

Figure 1:
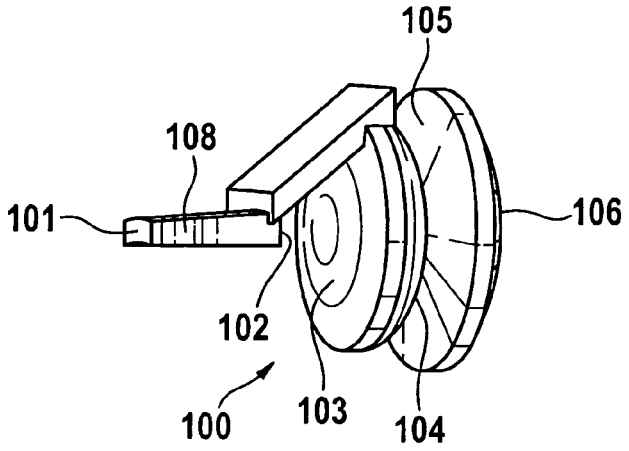
FIG. 1 shows an example of an embodiment of a headlight lens by way of a perspective representation.
Figure 2:
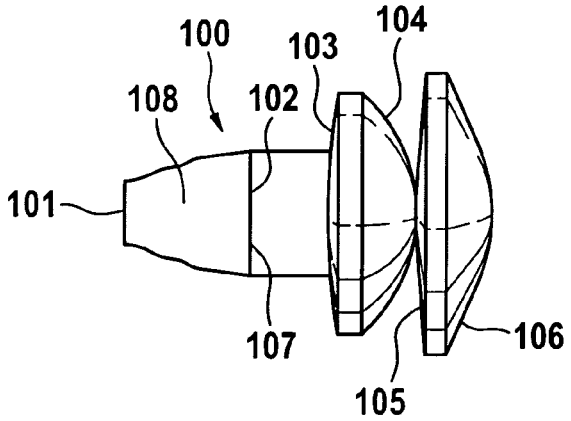
FIG. 2 shows the headlight lens according to FIG. 1 by way of a bottom view (view from below)
Figure 3:
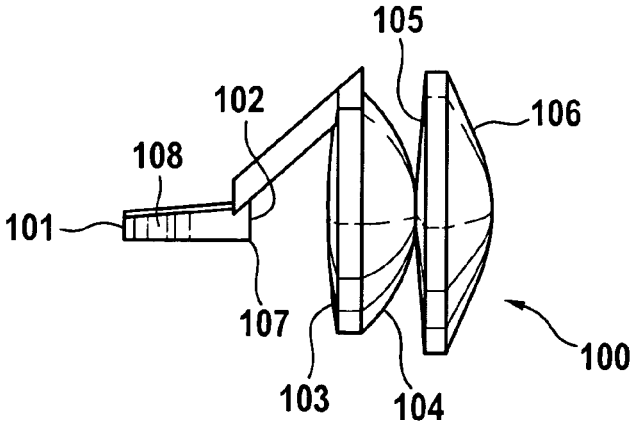
FIG. 3 shows the headlight lens according to FIG. 1 by way of a side view.
Figure 4:
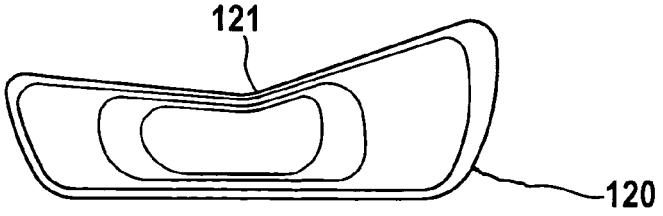
FIG. 4 shows an example of embodiment of an area illuminated by means of the headlight lens according to FIG. 1 at a distance of 10 m in front of the headlight lens according to FIG. 1.

FIG. 1 shows an example of embodiment of a headlight lens 100 for a motor vehicle headlight by way of a perspective rear view, wherein the headlight lens 100 is represented by way of a bottom view (view from below) in FIG. 2 and by way of a side view in FIG. 3. The headlight lens 100 comprises a blank-moulded monolithic body of transparent material, which comprises a light tunnel 108 having a light entry face 101 and a light exit face 102. The blank-moulded monolithic body or the headlight lens 100, respectively, comprises, moreover, a light entry face 103, through which light which exits through the light exit face 102 from the headlight lens 100 enters the headlight lens 100 anew. In addition, the headlight lens 100 comprises a further light exit face 104, a further light entry face 105, as well as a further light exit face 106. The light exit face 102 comprises a lower edge 107, which edge is mapped as a light-dark-boundary 121, as represented in FIG. 4, by means of an area (or light passage section) of the headlight lens 100, which area is restricted by the light entry face 103 and the light exit face 106, wherein reference numeral 120 designates an illuminated area at a distance of 10 m in front of the headlight lens 100, which area is illuminated by means of the headlight lens 100 when light is irradiated into or made to enter, respectively, the headlight lens 100 for example by means of a light strip element through the light entry face 101.

Figure 5:
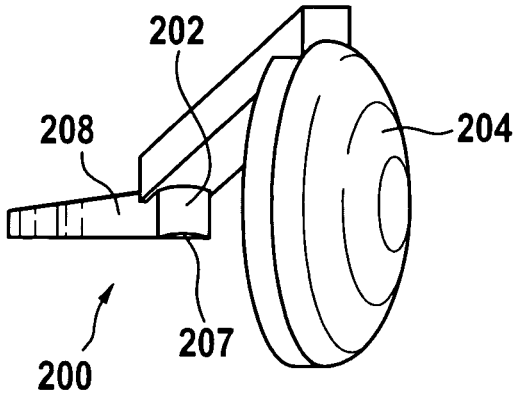
FIG. 5 shows a further example of embodiment of a headlight lens by way of a perspective representation.
Figure 6:
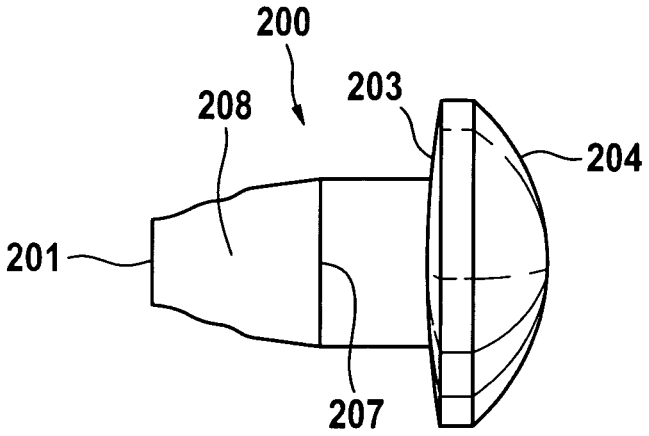
FIG. 6 shows the headlight lens according to FIG. 5 by way of a bottom view (view from below)
Figure 7:
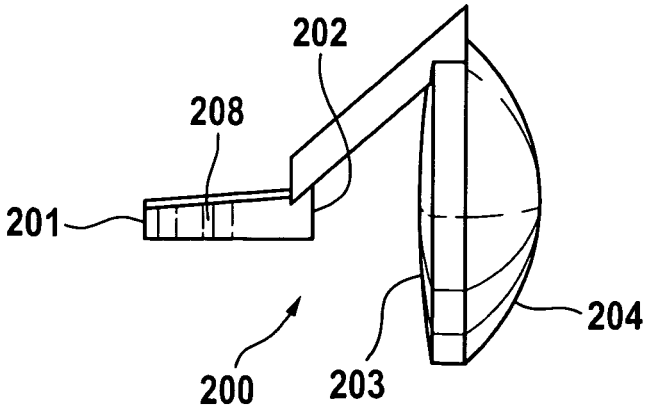
FIG. 7 shows the headlight lens according to FIG. 5 by way of a side view.

FIG. 5 shows a further example of embodiment of a headlight lens 200 for a motor vehicle headlight by way of a perspective front view, wherein the headlight lens 200 is represented in FIG. 6 by way of a bottom view (view from below) and in FIG. 7 by way of a side view. The headlight lens 200 comprises a blank-moulded monolithic body from transparent material, which body comprises a light tunnel 208 having a light entry face 201 and a light exit face 202. The blank-moulded monolithic body or the headlight lens 200, respectively, moreover comprises a light entry face 203, through which light, which exits from the headlight lens 200 through the light exit face 202, enters the headlight lens 200 anew. In addition, the headlight lens 200 comprises a further light exit face 204. The light exit face 202 comprises a lower edge 207, which is mapped as a light-dark-boundary by means of an area (or light passage section, respectively) of the headlight lens 200, which area is restricted by the light entry face 203 and the light exit face 204, said imaging occurring when light is irradiated into or made to enter, respectively, the headlight lens 200 for example by means of a light strip element through the light entry face 201.

Figure 8:
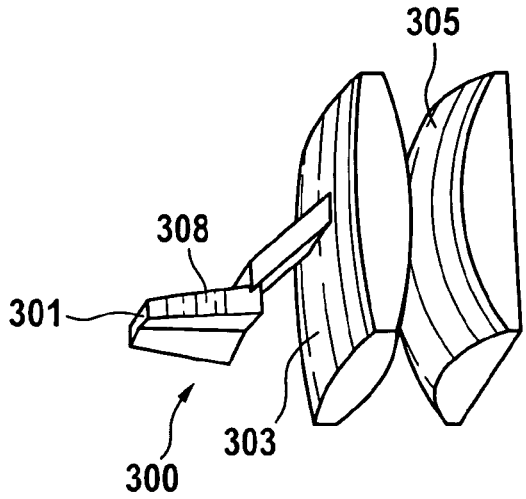
FIG. 8 shows a further example of embodiment of a headlight lens by way of a perspective representation.
Figure 9:
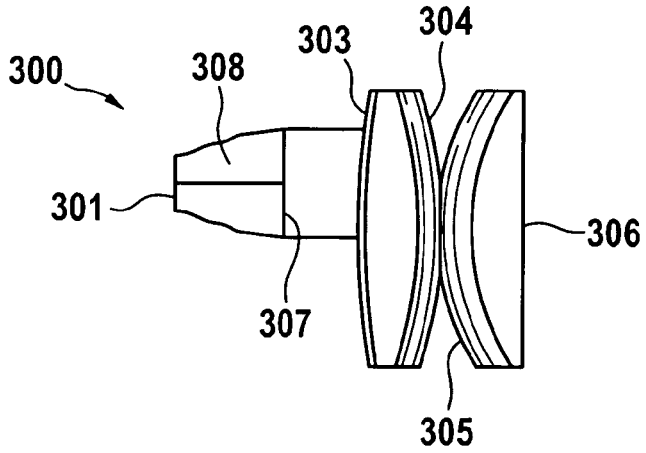
FIG. 9 shows the headlight lens according to FIG. 8 by way of a bottom view (view from below)
Figure 10:
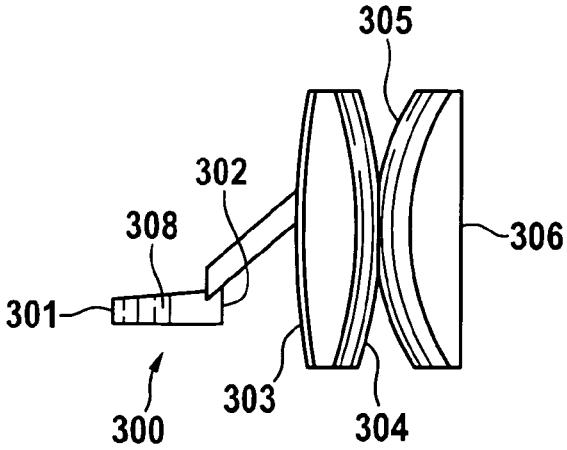
FIG. 10 shows the headlight lens according to FIG. 8 by way of a side view.

FIG. 8 shows a further example of embodiment of a headlight lens 300 for a motor vehicle headlight by way of a perspective rear view, wherein the headlight lens 300 is represented by way of a bottom view (view from below) in FIG. 9 and by way of a side view in FIG. 10. The headlight lens 300 comprises a blank-moulded monolithic body from transparent material, which body comprises a light tunnel 308 having a light entry face 301 and a light exit face 302. The blank-moulded monolithic body or the headlight lens 300 moreover comprises a light entry face 303, through which light, which exits from the headlight lens 300 through the light exit face 302, enters the headlight lens 300 anew. In addition, the headlight lens 300 comprises a further light exit face 304, a further light entry face 305, as well as a further light exit face 306. The light exit face 302 comprises a lower edge 307, which is mapped as a light-dark-boundary by means of an area (or light passage section, respectively) of the headlight lens 300, which area is restricted by the light entry face 303 and the light exit face 306, said imaging occurring when light is irradiated into or made to enter, respectively, the headlight lens 300 for example by means of a light strip element through the light entry face 301.

Figure 11:
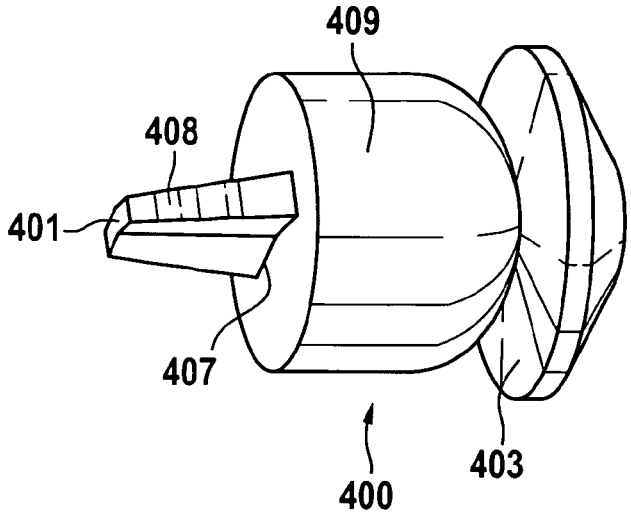
FIG. 11 shows a further example of embodiment of a headlight lens by way of a perspective representation.
Figure 12:
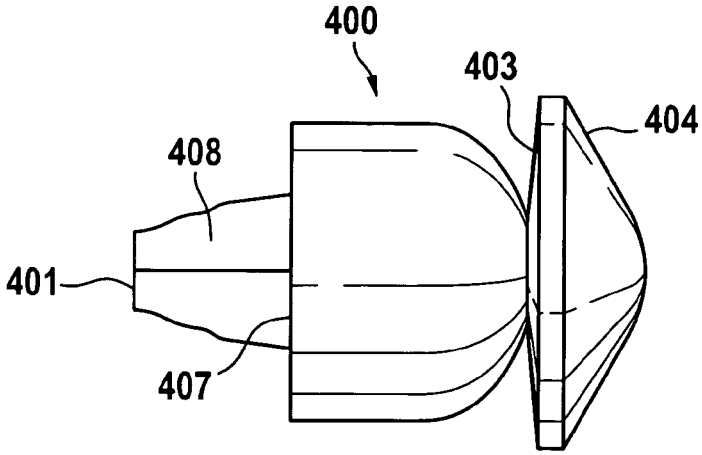
FIG. 12 shows the headlight lens according to FIG. 11 by way of a bottom view (view from below)
Figure 13:
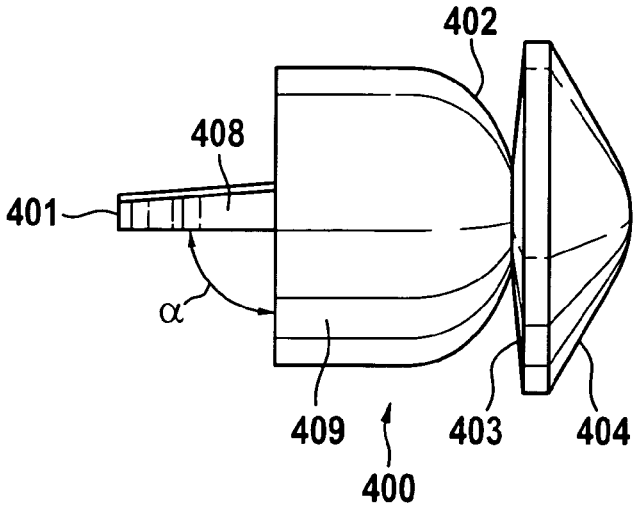
FIG. 13 shows the headlight lens according to FIG. 11 by way of a side view.

FIG. 11 shows a further example of embodiment of a headlight lens 400 for a motor vehicle headlight by way of a perspective rear view, wherein the headlight lens 400 is represented by way of a bottom view (view from below) in FIG. 12 and by way of a side view in FIG. 13 and FIG. 14. The headlight lens 400 comprises a blank-moulded monolithic body from transparent material, which body comprises a light tunnel 408 having a light entry face 401 on one side and transiting into a light passage section (or portion) 409 via a bend (or via a curvature, respectively) 407, on the other side, which light passage section includes a light exit face 402, a light entry face 403, as well as a further light exit face 404. Herein, the light passage section 409 maps the bend 407, as has been represented in FIG. 15, as a light-dark-boundary 421, wherein reference numeral 420 designates the area illuminated by means of the headlight lens 400 at a distance of 10 m in front of the headlight lens 400,—when light is irradiated into or made to enter, respectively, the headlight lens 400 for example by means of a light strip element through the light entry face 401—. In the represented example of embodiment, the transparent body has an opening angle $\alpha$ of approximately 90° in the bend 407 between the surface of the light tunnel 408, which extends in the direction of the optical axis, and the surface of the light passage section 409, which is facing the light entry face 401.

Figure 14:
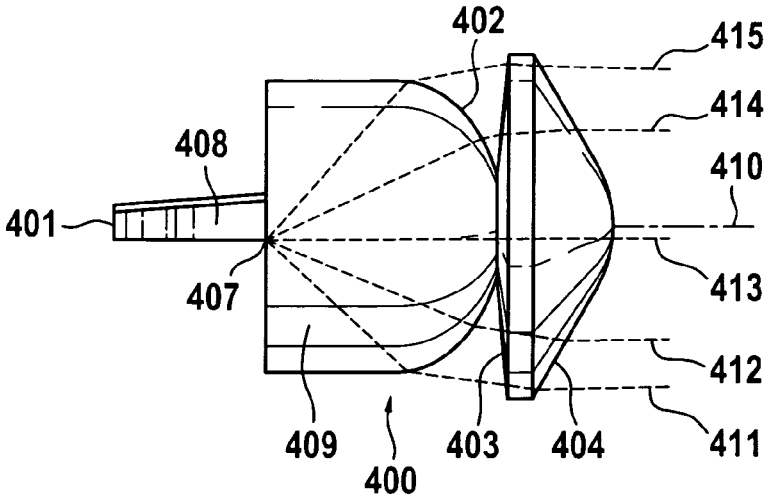
FIG. 14 shows the headlight lens according to FIG. 11 by way of a further side view.
Figure 15:
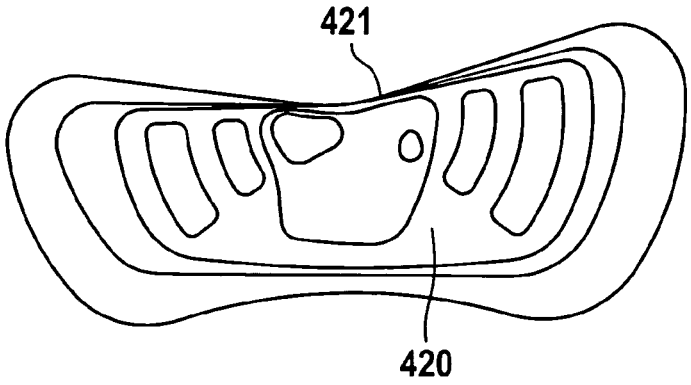
FIG. 15 shows an example of embodiment of an area illuminated by means of the headlight lens according to FIG. 12 at a distance of 10 m in front of the headlight lens according to FIG. 12.

The headlight lens 400 is configured such that light—as has been represented in FIG. 14—, which is entering the transparent body or the headlight lens 400, respectively, through the light entry face 401 and is entering the light passage section in the region of the bend 407 of the light tunnel 408, will exit from the light exit face 404 essentially parallel to the optical axis of the headlight lens 400. In FIG. 14 reference numerals 411, 412, 414, and 415 designate light beams which, exiting through the light exit face 402 from the transparent body, will enter the transparent parent body again through the light entry face 403 and will exit anew from the transparent body through the light exit face 404. Reference numeral 413 designates a light beam which enters the headlight lens 400 through the light entry face 401 and exits through the light exit face 404, however, without exiting from the light exit face 402 or without entering the light entry face 403.

Figure 16:
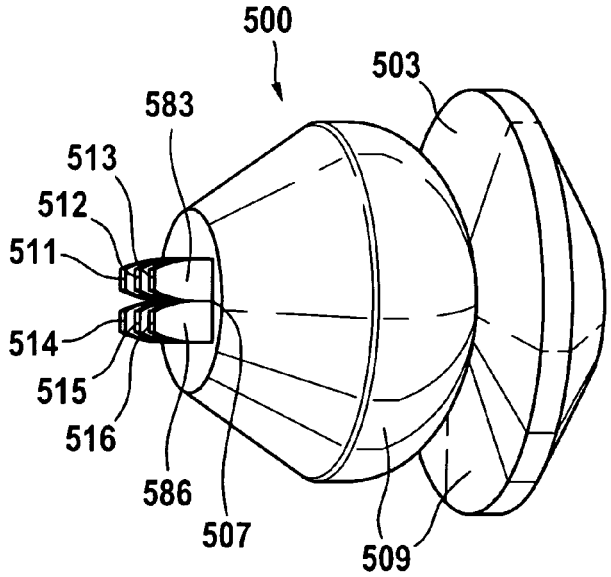
FIG. 16 shows a further example of embodiment of a headlight lens by way of a perspective representation.
Figure 17:
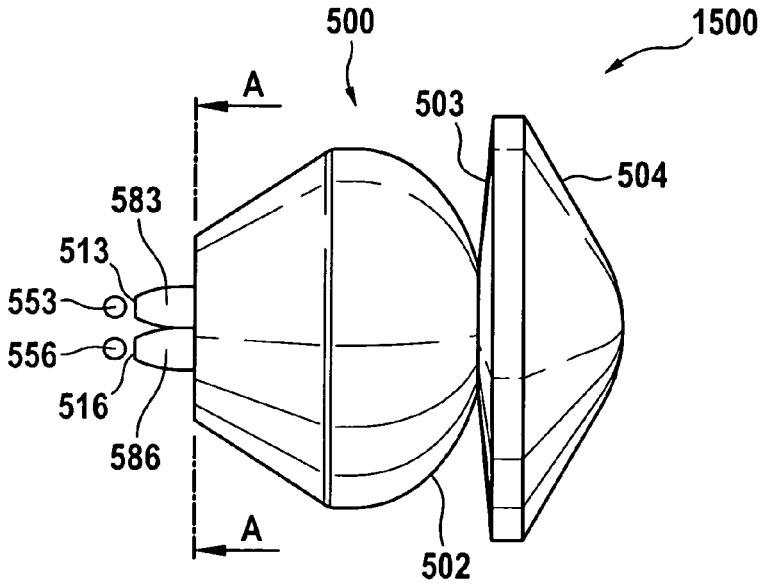
FIG. 17 shows a motor vehicle headlight including the headlight lens according to FIG. 16 by way of a side view.
Figure 18:
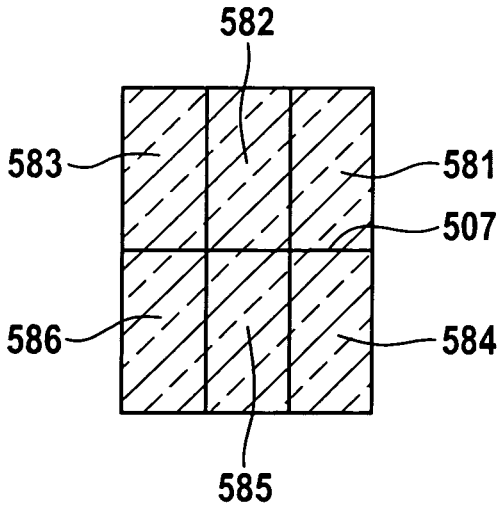
FIG. 18 shows a sectional representation of the headlight lens according to FIG. 17 along a plane of section designated A-A in FIG. 17.
Figure 19:
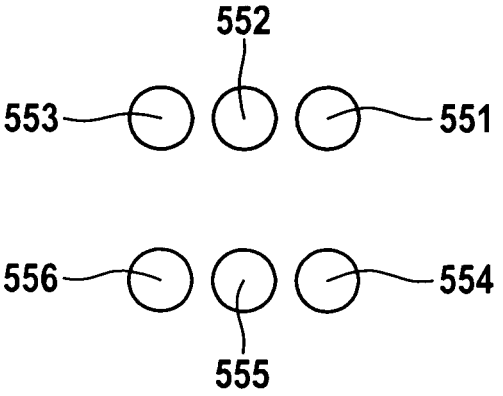
FIG. 19 shows an example of embodiment of an array of LED's of a motor vehicle headlight according to FIG. 17.

FIG. 16 shows an example of embodiment of a headlight lens 500 for a motor vehicle headlight by way of a perspective rear view and modified with respect to headlight lens 400, wherein, in FIG. 17, the headlight lens 500 is represented by way of a side view (viewed from below) as part of a motor vehicle headlight 1500. FIG. 18 shows a sectional representation of the headlight lens 1500 along a plane of section designated A-A in FIG. 17. The headlight lens 500 comprises a blank-moulded monolithic body of transparent material including six light tunnels 581, 582, 583, 584, 585, and 586 including corresponding light entry faces 511, 512, 513, 514, 515, 516, with which have been associated, as has been represented in FIG. 19 in a viewing direction from the headlight lens 500, LED's 551, 552, 553, 554, 555, 556, respectively, for making light enter the light entry faces 511, 512, 513, 514, 515, 516, respectively, (having a light beam density of at least 75 lm/mm$^2$). The light tunnels 581, 582, 583 transit into a light passage section 509 by means of a bend (or a curvature, respectively) 507 on their sides facing away from the light entry faces 511, 512, 513, which light passage section 509 has a light exit face 502, a light entry face 503, as well as a further light entry face 504. Herein, the light passage section 509 maps the bend 507 as a light-dark-boundary when the LEDs 551, 552, 553 have been switched on and the LEDs 554, 555, 556 have been switched off (dimming mode). In a mode of long distance light the LEDs 551, 552, 553 and the LEDs 554, 555, 556 are switched on.

Figure 20:
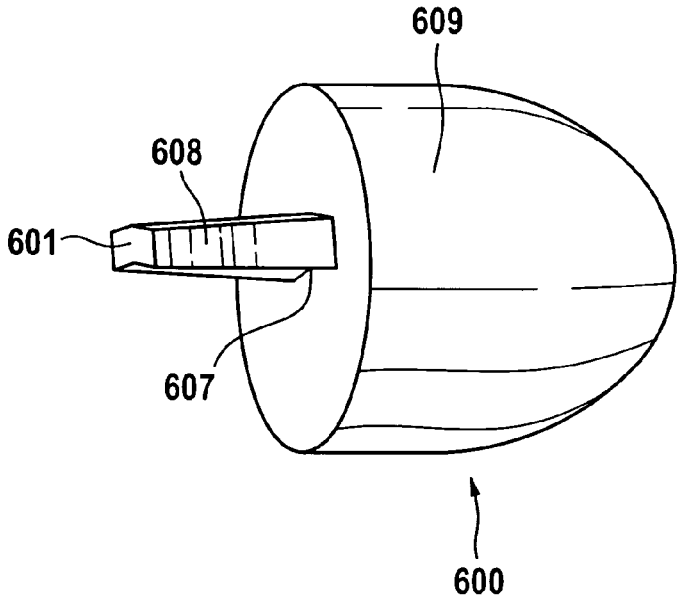
FIG. 20 shows a further example of embodiment of a headlight lens by way of a perspective representation.
Figure 21:
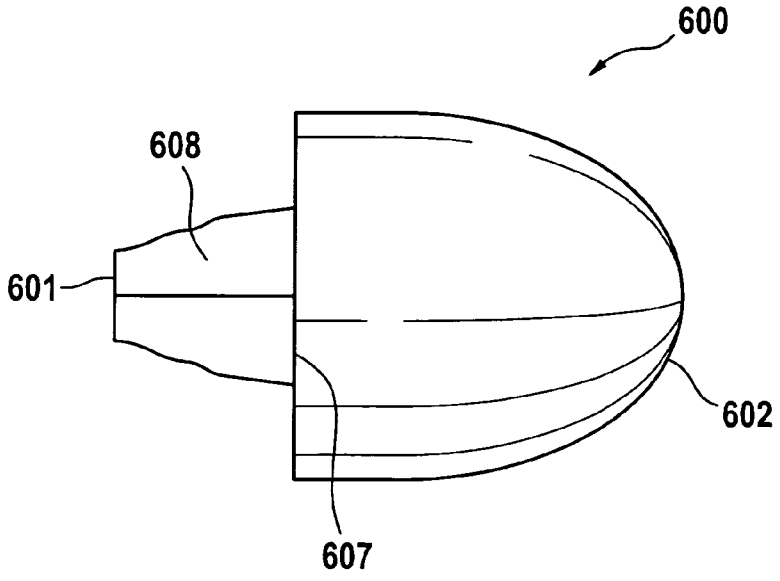
FIG. 21 shows the headlight lens according to FIG. 20 by way of a bottom view (view from below)
Figure 22:
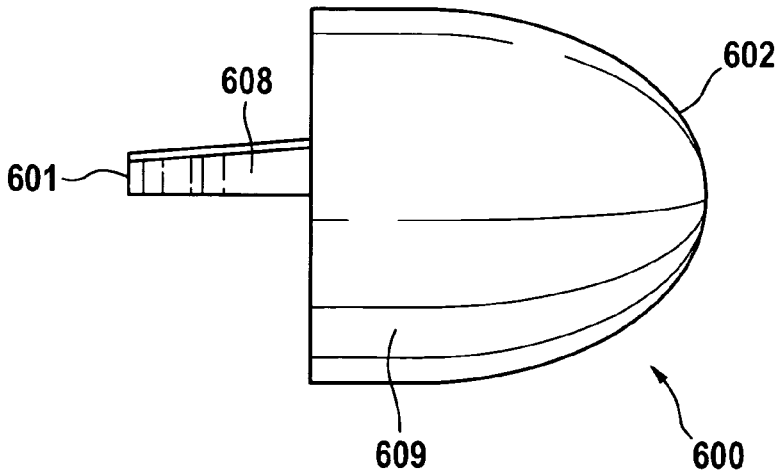
FIG. 22 shows the headlight lens according to FIG. 20 by way of a side view.
Figure 23:
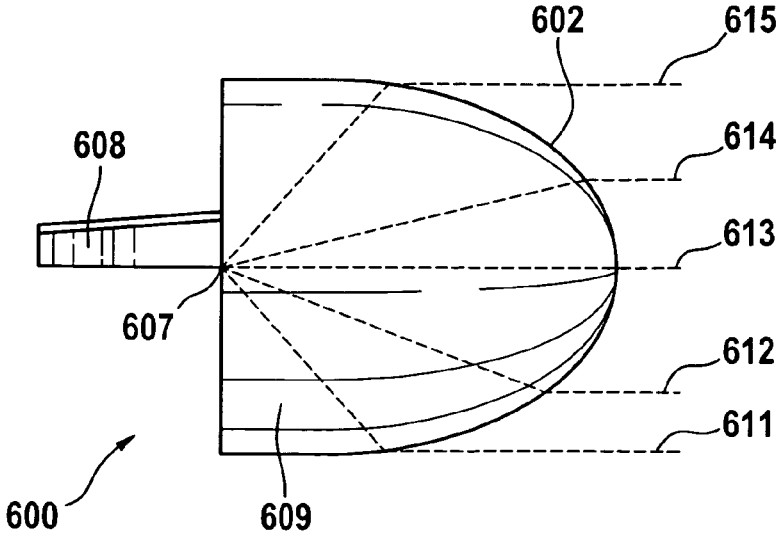
FIG. 23 shows a further side view of the headlight lens according to FIG. 20.

FIG. 20 shows a further example of embodiment of a headlight lens 600 for a motor vehicle headlight by way of a perspective rear view, wherein the headlight lens 600 is represented by way of a bottom view (view from below) in FIG. 21 and by way of a side view in FIG. 22 and FIG. 23. The headlight lens 600 comprises a blank-moulded monolithic body from transparent material, which body comprises a light tunnel 408 including a light entry face 601 on one side and transits into a light passage section 609 via a bend (or via a curvature, respectively) 607, on the other side, which light passage section has a light exit face 602. Herein, the light passage section 609 maps the bend 607 as a light-dark-boundary. The headlight lens 600 is configured such that light—as has been represented in FIG. 23—, which is entering the transparent body or the headlight lens 600, respectively, through the light entry face 601 and is entering the light passage section in the region of the bend 607 of the light tunnel 608, will exit from the light exit face 604 essentially parallel to the optical axis of the headlight lens 600. In FIG. 14 (remark by translator: correct "23") reference numerals 611, 612, 614, and 615 designate light beams exiting through the light exit face 602 from the transparent body, that will enter the transparent parent body anew through the light entry face 603 and will again exit from the transparent body through the light exit face 604. Reference numeral 613 designates a light beam which enters the headlight lens 600 through the light entry face 601 and exits through the light exit face 604, however, without exiting from the light exit face 602 or without entering the light entry face 603. The light beam 613 indicates the position of the optical axis of the headlight lens 600.

The invention claimed is:

1. Headlight lens for a vehicle headlight, the headlight lens having:

a monolithic body of transparent material, the monolithic body including a light tunnel comprising at least one light entry face and a light passage section comprising at least one light exit face;

wherein the light tunnel at its bottom passes over into the light passage section via a bend at the transition of the light tunnel and the light passage, the bend having a radius of curvature of between, 0.25 mm and 0.05 mm, and wherein the light exit face is configured for imaging the bend as a light-dark-boundary by means of light emitted into the light entry face.

2. The headlight lens of claim 1, wherein the light tunnel is arranged between the bend and the light entry face.

3. The headlight lens of claim 2, wherein the light passage section is arranged between the bend and the light exit face.

4. The headlight lens of claim 3, wherein the bend is arranged on a surface of the light passage section facing the light entry face.

5. The headlight lens of claim 1, wherein the light passage section is arranged between the bend and the light exit face.

6. The headlight lens of claim 1, wherein the bend comprises an opening angle of at least 90°.

7. The headlight lens of claim 1, wherein the bend comprises an opening angle of no more than 150°.

8. The headlight lens of claim 1, wherein the bend is arranged on a surface of the light passage section facing the light entry face.

9. The headlight lens of claim 1, wherein the monolithic body comprises at least one second light tunnel, which passes into the light passage section via a second bend.

10. Headlight lens for a vehicle headlight, the headlight lens having:

a monolithic body of transparent material, the monolithic body including a first light tunnel having a first light entry face;

a second light tunnel having a second light entry face;

a light passage section having at least one optically operative light exit face;

the first light tunnel passing over into the light passage section via a first bend and being arranged between the first bend and the first light entry face;

the second light tunnel passing over into the light passage section via a second bend and being arranged between the second bend and the second light entry face; and the light passage section being arranged between the first bend and the light exit face for imaging the first bend as a light-dark-boundary.

11. The headlight lens of claim 10, wherein the bend comprises an opening angle of at least 90°.

12. The headlight lens of claim 10, wherein the bend comprises an opening angle of no more than 150°.

13. The headlight lens of claim 10, wherein the bend is arranged on a surface of the light passage section facing the light entry face.

14. The headlight lens of claim 10, wherein the monolithic body comprises at least one second light tunnel, which passes into the light passage section via a second bend.

15. Headlight lens for a vehicle headlight, the headlight lens having:

a monolithic body of transparent material, the monolithic body including a first optically operative light entry face;

at least a second optically operative light entry face;

a first optically operative light exit face;

at least a second optically operative light exit face;

a light passage section; and a light tunnel passing over into the light passage section via a bend, the light passage section being configured for imaging the bend as a light-dark-boundary; and the monolithic body being configured that at least 20% of the light entering the first light entry face and exiting from the second light exit face is light to be exiting through the second light exit face after having exited from the monolithic body through the first light exit face and entered the monolithic body through the second light entry face.

16. The headlight lens of claim 15, the monolithic body being configured that at least 10% of the light entering the first light entry face and exiting from the second light exit face is light to be exiting through the second light exit face without having exited from the monolithic body through the first light exit face and without having entered the monolithic body through the second light entry face.

17. The headlight lens of claim 16, wherein the light tunnel is arranged between the bend and the first light entry face.

18. The headlight lens of claim 17, wherein the light passage section is arranged between the bend and the second light exit face.

19. The headlight lens of claim 18, wherein the bend is arranged on a surface of the light passage section facing the first light entry face.

20. The headlight lens of claim 16, wherein the bend comprises an opening angle of at least 90°.

21. The headlight lens of claim 16, wherein the bend comprises an opening angle of no more than 150°.

22. The headlight lens of claim 16, wherein the bend is arranged on a surface of the light passage section facing the first light entry face.

23. The headlight lens of claim 15, wherein the light passage section is arranged between the bend and the second light exit face.

24. The headlight lens of claim 15, wherein the monolithic body comprises at least a second light tunnel, which passes into the light passage section via a second bend.

* * * * *